US005483706A

United States Patent [19]

Tsai et al.

[11] Patent Number: 5,483,706

[45] Date of Patent: Jan. 16, 1996

[54] FLUSH DEVICE FOR TOILET

[76] Inventors: Pang-Yen Tsai; Chien-Liang Hsiao, both of Suite 1, 11F, 95-8, Chang Ping Road, Sec. 1, Taichung, Taiwan

[21] Appl. No.: 367,729

[22] Filed: Jan. 3, 1995

[51] Int. Cl.[6] ..... E03D 1/14

[52] U.S. Cl. ..... 4/325; 4/394

[58] Field of Search ..... 4/324, 325, 378, 4/392, 393, 394, 405, 411, 412, 413, 414, 415

[56] References Cited

U.S. PATENT DOCUMENTS 2,046,888 7/1936 Watt ..... 4/412

2,412,738 12/1946 Martin ..... 4/412

4,080,668 3/1978 Banes ..... 4/325

*Primary Examiner*—Robert M. Fetsuga

[57] ABSTRACT

A flush device for toilet comprises within a water tank a support arm including a check member, a restricting member and a outlet valve attached in series to an overflow tube, and an actuating assembly including a actuator arm connected with the outlet valve via the support arm by a lift wire or chain. The check member facilitates varying the discharge amount of the flush water and smooth operation in different modes.

12 Claims, 10 Drawing Sheets

FLUSH DEVICE FOR TOILET

BACKGROUND OF THE INVENTION

The present invention relates to water closet, more particular to a flush device for toilet, which device is adjustable for varying the discharge amount of the flush water into a toilet pan.

Prior art toilets generally comprise a water tank having a water inlet device and a flush device therein. The water inlet device is similarly composed of a tube and a ball-cock assembly on the top thereof connecting a float arm with a float ball thereon. When the pouring in water reaches to a certain lever in the water tank, the float ball then actuates the ball-cock via the float arm so as to stop the water from continuously pouring in. The flush device may vary in shape but generally has a valve seat, a tank ball pivotally connected to an overflow tube and suspended from a lever means via a lift wire, and a flush handle connected with the lever means that actuates the tank ball upward for discharging the flush water into a toilet pan.

Their common disadvantages are characterized in lacking of structural flexibility for adjusting the discharge amount of the flush water therein so that every time when the flush device is actuated, a tankful of water is discharged totally regardless whether such large amount of water is needed. Since, in many occasions such as to flush urine or a small amount of excreta, a smaller amount of flush water is sufficient, it causes a waste of water source, which is uneconomical and detrimental to the environmental requirement.

In our U.S. Pat. No. 5,396,666 we provide an adjustable flush device for varying the discharge amount of the flush water in which a support arm and a restricting member are displaceable and invertable on the overflow tube in cooperation with a retaining actuating assembly, so that it effectively controls the discharge of the flush water from the water tank. However, an inefficiency has been found on the restricting device that when discharging a small amount of flush water, the user has to continuously press the handle of the actuating assembly until a satisfied amount of water is flushed. This is because of that there lacks a check member to control the sliding movement of the lift wire.

SUMMARY OF THE PRESENT INVENTION

The present invention has a main object to provide a flush device for toilets which is structurally improved to enable the discharge amount of flush water to be controllable.

Another object of the present invention is to provide a flush device for toilets, which is structurally displaceable and invertible to facilitate the flush handle thereof to be operated in an inverse direction in order to cope with the operational habit of the users.

Accordingly, the present invention of a flush device for toilets generally comprises an overflow tube having coupled thereto in sequence a support arm, a restricting member and a outlet valve, a lift wire or chain connected on one end with the outlet valve and the other end with an actuating assembly in order to lift up the outlet valve for discharging a selective amount of flush water into the toilet pan from the water tank, and a check member connected to the support arm for controlling the sliding movement of the lift wire during provision of a small amount of the flush water. The restricting member which has a pair of upward projected rods and transverse spring therebetween is provided to limit the span of the downward movement of the lever means and the outlet valve in varied levels. The restricting member can be affixed upside down to the overflow tube thereby altering upward movement of the lever means.

The present invention will be fully understood by reference to the following detailed description thereof when read in light of the attached drawings.

DETAILED DESCRIPTION OF THE PREFERRED EMBODIMENT OF THE PRESENT INVENTION

Figure 1:
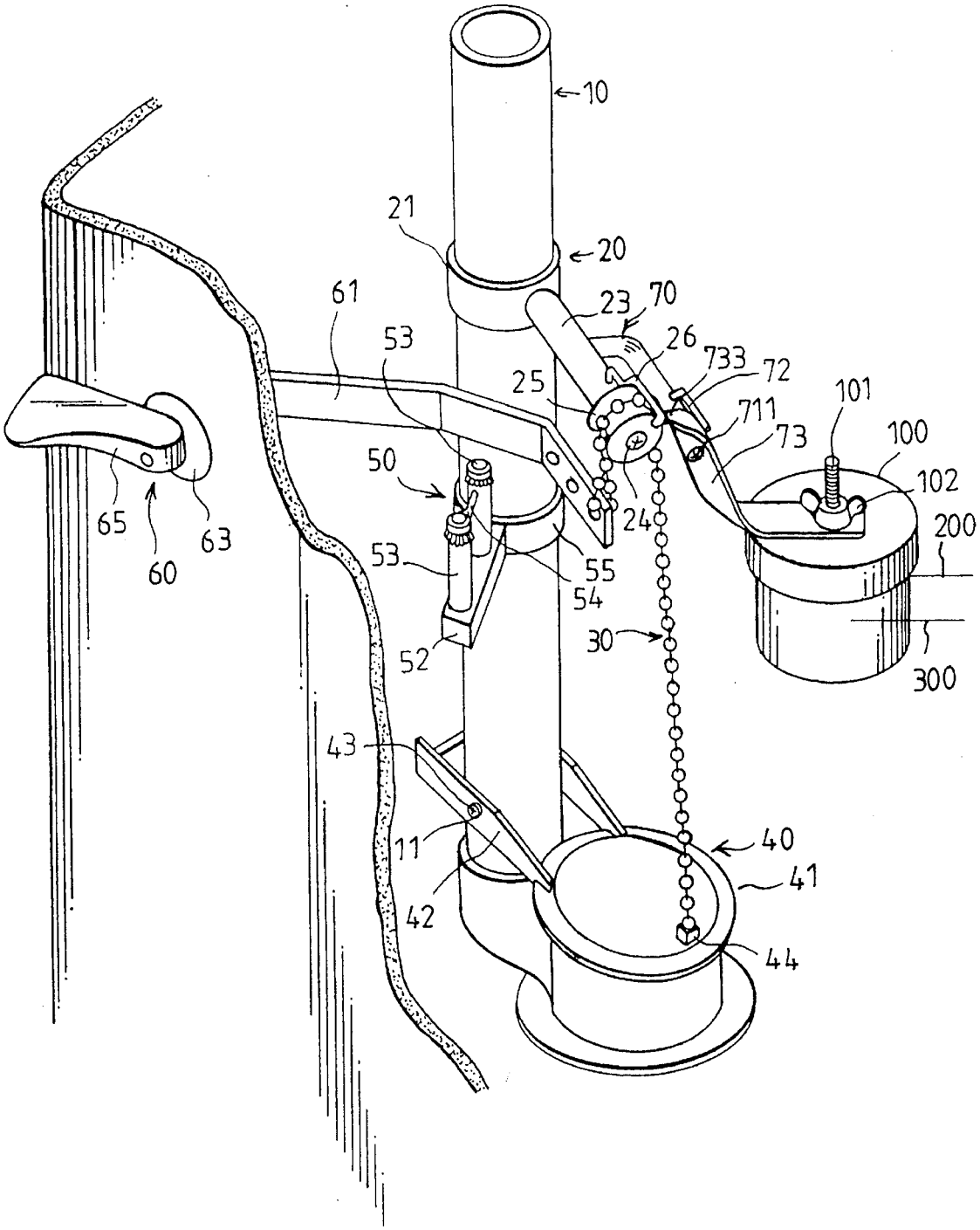
FIG. 1 is a perspective view to show a preferred embodiment of the present invention.
Figure 2:
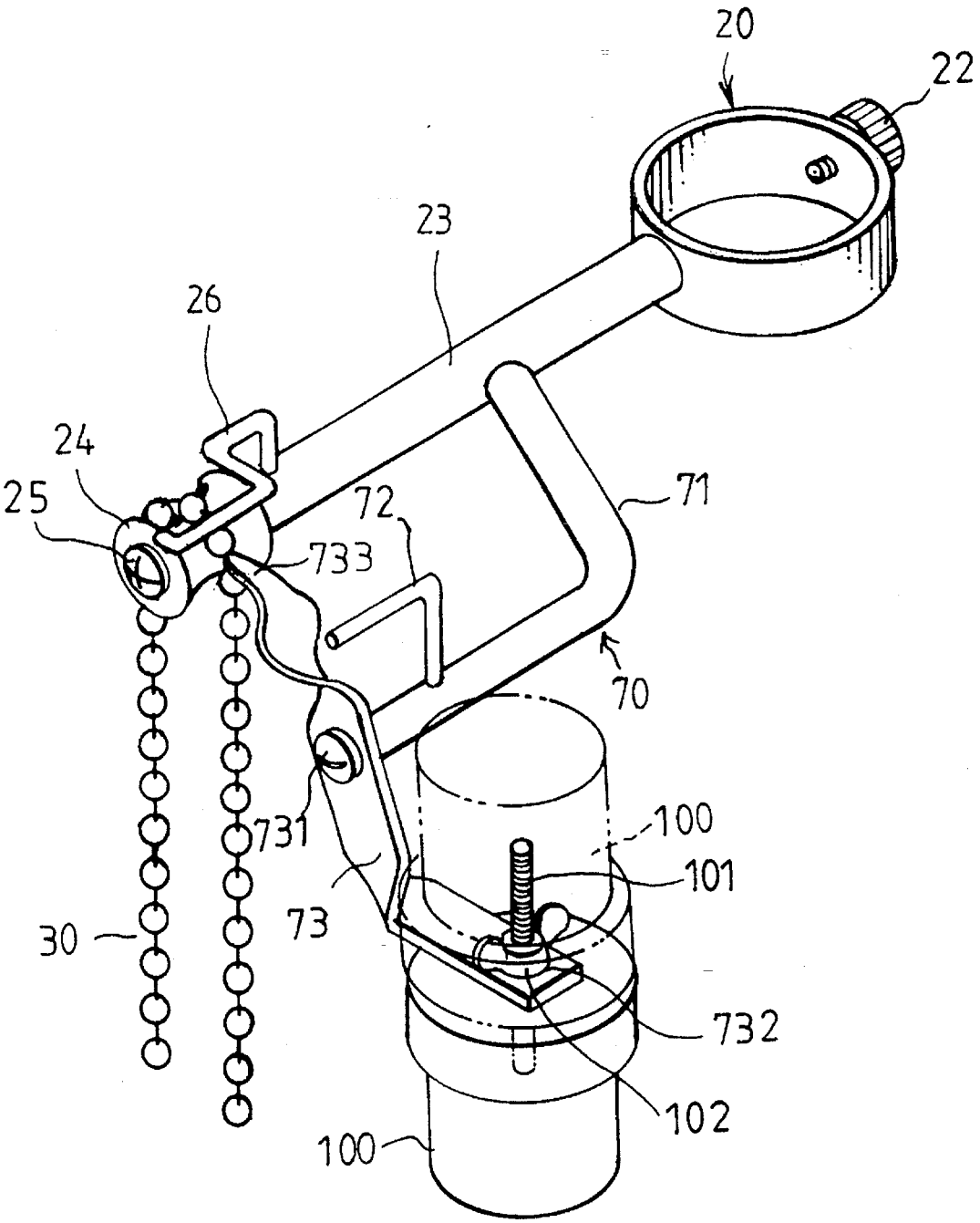
FIG. 2 is a perspective view to show a check member of the preferred embodiment of the present invention.

With reference to FIGS. 1 and 2 of the drawings, the present invention of a flush device for toilet comprises generally an overflow tube 10, a support arm 20, a lift wire or chain 30, an outlet valve 40, a retricting member 50, an actuating assembly 60 and a check member 70 disposed in a water tank.

The support arm 20 comprises a cylindrical body 23 having on one end a retaining ring 21 and other end with a pulley 24 which is perpendicularly secured in rotation by a slotted screw 25 and abutted upon a catch pawl 26 which is affixed to a peripheral hole of the cylindrical body 23. The support arm is telescoped to the upper portion of the overflow tube and secured by a screw 22 thereon with the pulley end keeping in aligment with the valve seat of the tank.

The outlet valve 40 comprises a flying-disk shaped body of hollow interior having a circular flange 41 and a clevis 42 extended from a peripheral end thereof which has a pair of axle apertures 43 on opposing medial portions for pivoting to the outer periphery at the lower portion of the overflow tube 10 by an axle pin 11. The free ends of the clevis 42 are connected with a transverse rod. A hoop means 44 is disposed opposite the clevis 42 for connecting with the lift wire 30.

The lift wire or chain 30 which is suspended from the pulley connects on one end with the outlet valve 40 and other end with the actuating assembly 60.

The restricting member 50 comprises an elongate rectangular body 52 having a pair of spaced vertical rods 53 projected upward at upper surface therefrom and a recoil spring 54 connected between their upper ends. A retaining ring 55 is connected to one end of the elongate body 52 and secured by a screw to the medial portion of the overflow tube 10, with the elongate body directed to the front side of the water tank.

Figure 9:
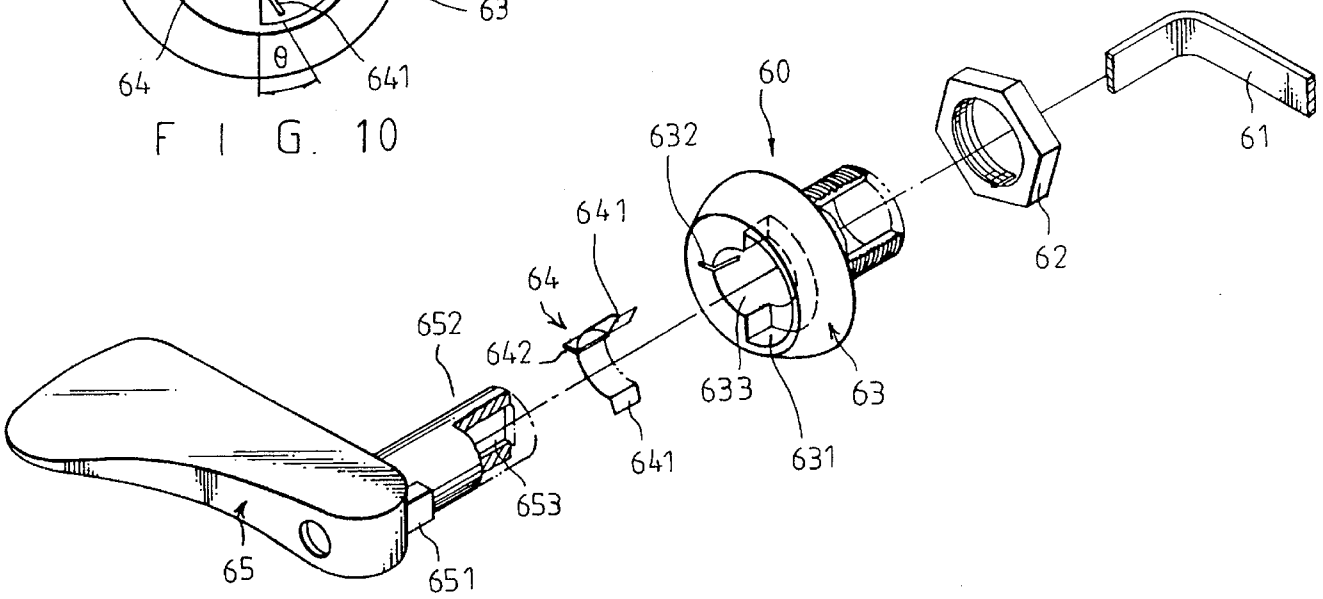
FIG. 9 is an exploded perspective view to show in detail an actuation assembly of the present invention.
Figure 10:
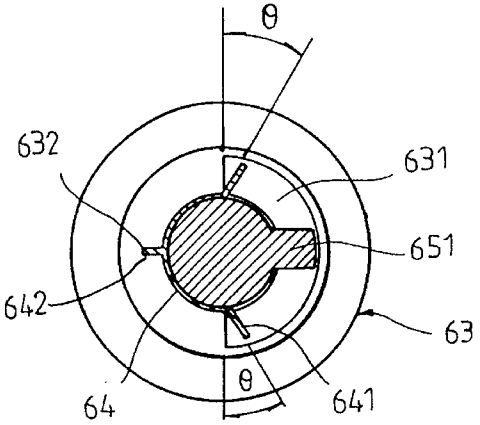
FIG. 10 is a sectional view of FIG. 9.

Referring to FIGS. 9 and 10, the actuating assembly 60 comprises an actuator arm 61, a hexagonal nut 62, Jack means 63, a spring detent 64 and a strip handle 65.

The actuator arm 61 has a transverse portion, two bends and three circular holes (see FIG. 1). The jack means 63 has a centrally formed cylindrical recess, a larger diameter portion having a semi-circular groove 631 on front side, a notch 632 on the inner periphery thereof opposite to the groove 631 and a lesser diameter portion 633 with a threaded outer periphery projecting outward from the rear side. The spring detent 64 has a semi-circular body including a laterally bent flap 641 on each end and a central tab 642. The strip handle 65 has a cylindrical portion 652 and a rectangular protruding member 651 perpendicularly extending therefrom. The cylindrical portion 652 has a central slot 653 for the securement of the transverse portion of the lever bar 61 therein.

When assembling, fasten firstly the jack means 63 by the hexagonal nut 62 onto a circular hole provided at a proper position of the water tank. Then affix the spring detent 64 into the cylindrical recess of the jack means 63 with the tab 642 thereof inserted into the notch 632 and the bent flaps 641 against the end wails of the groove 631. And then insert the strip handle 65 cylindrical portion 652 into the cylindrical recess of the jack means 63 with the rectangular protruding stopper 651 engaged with the semi-circular groove 631 therein so that the strip handle 65 is retained by the spring detent 64 and restrictively rotates about the groove 631 (see FIG. 10). Finally, secure the transverse portion of the actuator arm 61 to the central slot 653 of the strip handle 65 and the other end of the actuator arm 61 to the lift wire 30 which is connected at the other end with the tank ball and suspends from the pulley of the support arm 20.

Referring to FIG. 2 of the drawings, the check member 70 comprises an L-shape suspender 71 connected at one end to a lateral periphery of the cylindrical body 23 of the support arm 20. The other end of the suspender 71 has a less diameter threaded portion (not shown), and a smaller L-shape catch pin 72 integrally connected at one end to an upper periphery of the suspender 71. A roughly Z-shape lever 73 having a circular hole 731 laterally formed at a medial portion is rotatably secured to the free end of the L-shape suspender 71 by means of a bolt 711. A float ball 100 having a threaded rod 101 is secured into a screw hole 732 near one end of the lever 73 and affixed by means of a wing nut 102. The lever 73 has also a check point 733 at a free end which is releasably positionable into the gap of two adjacent balls of the lift chain 30 for preventing the chain 30 from moving downward when the water in the tank is at highest level or stopping transiently when the water begins to drop down. Further reduction of the water level will cause the check point 733 to gradually release from the gap of the balls and set the chain free to move on the pulley 24. The catch pin 72 is provided to hinder the check point 733 from further outward rotating.

Figure 3:
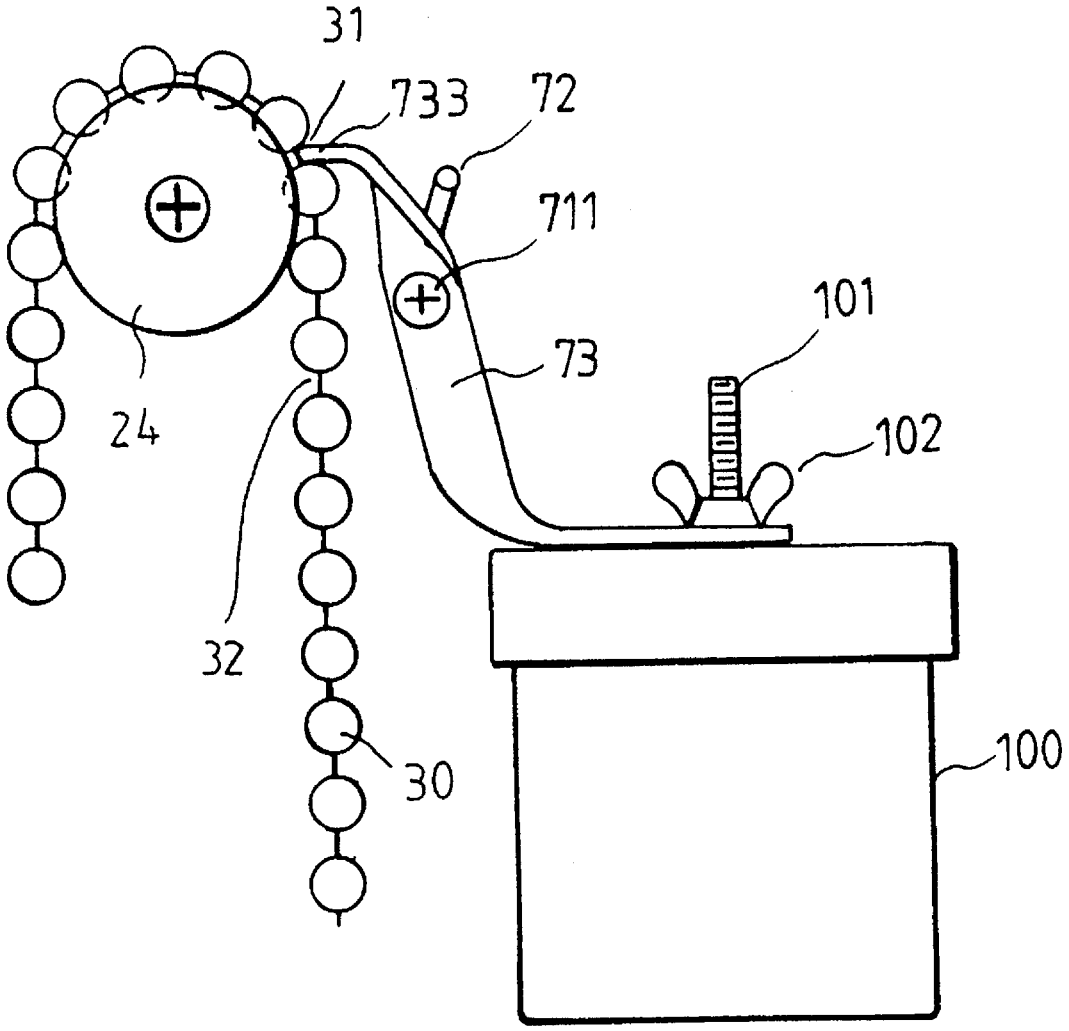
FIG. 3 is an elevational plane view to show the check member of the preferred embodiment of the present invention while the lift chain is at it's normal position.
Figure 4:
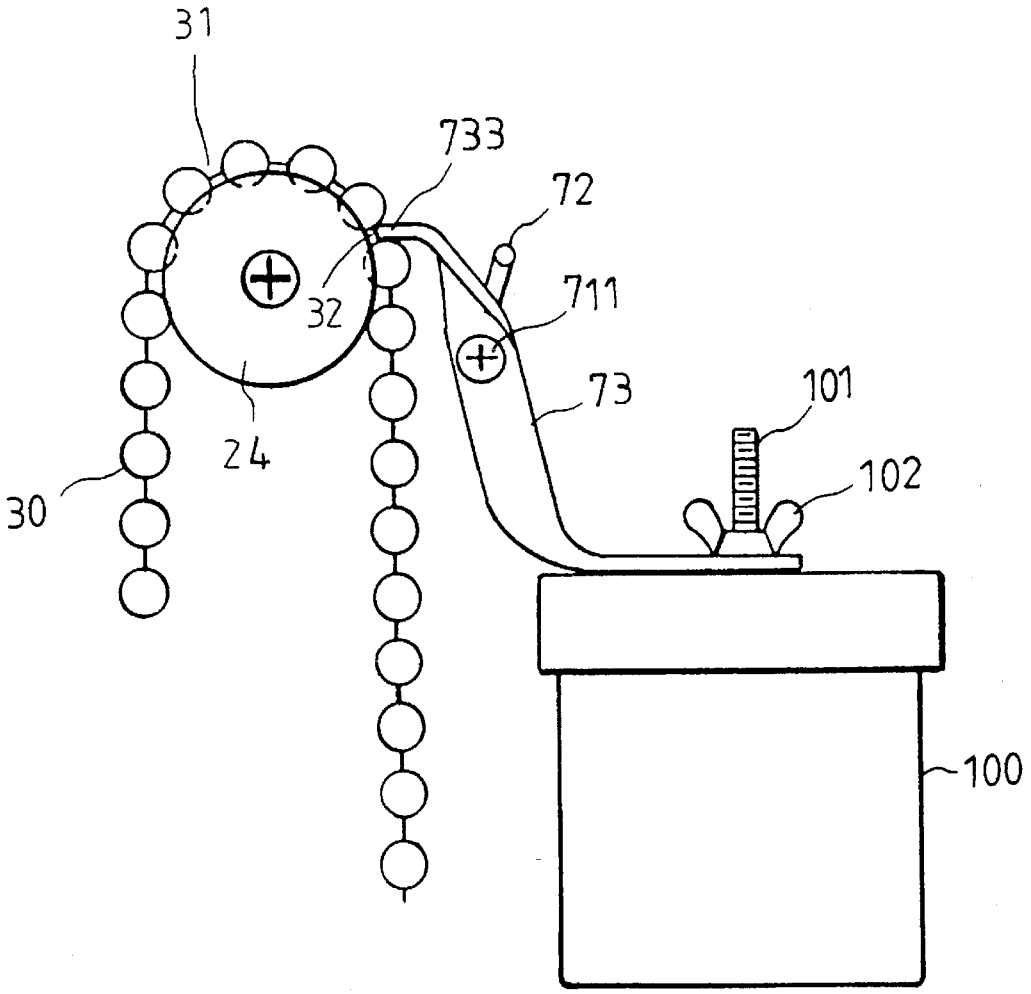
FIG. 4 is an elevational plane of FIG. 3 to show the lift chain being slidingly dragged by an actuator arm of the present invention.
Figure 5:
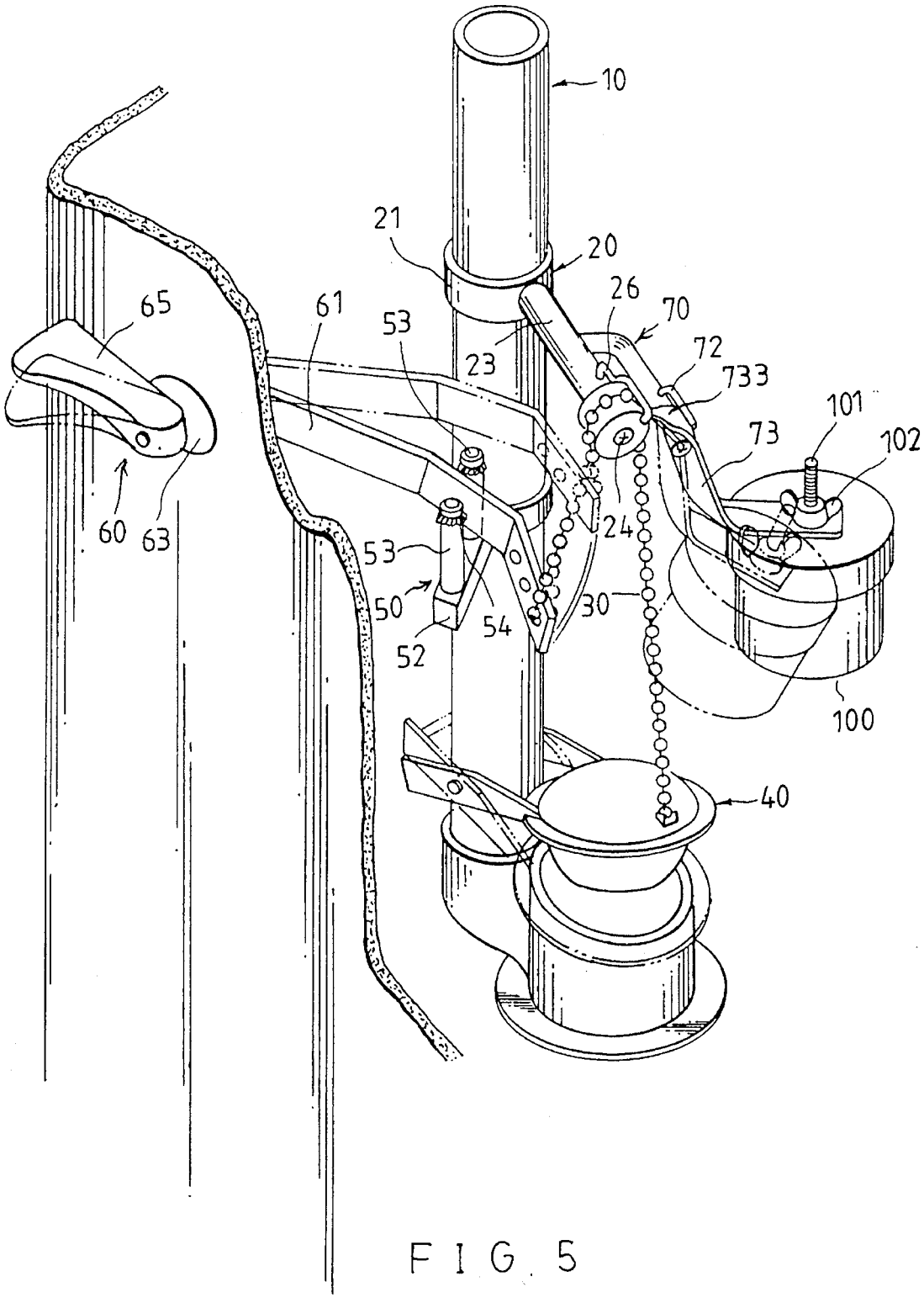
FIG. 5 is a perspective view of FIG. 1 to show the actuator arm being operated to release a small amount of the flush water.
Figure 8:
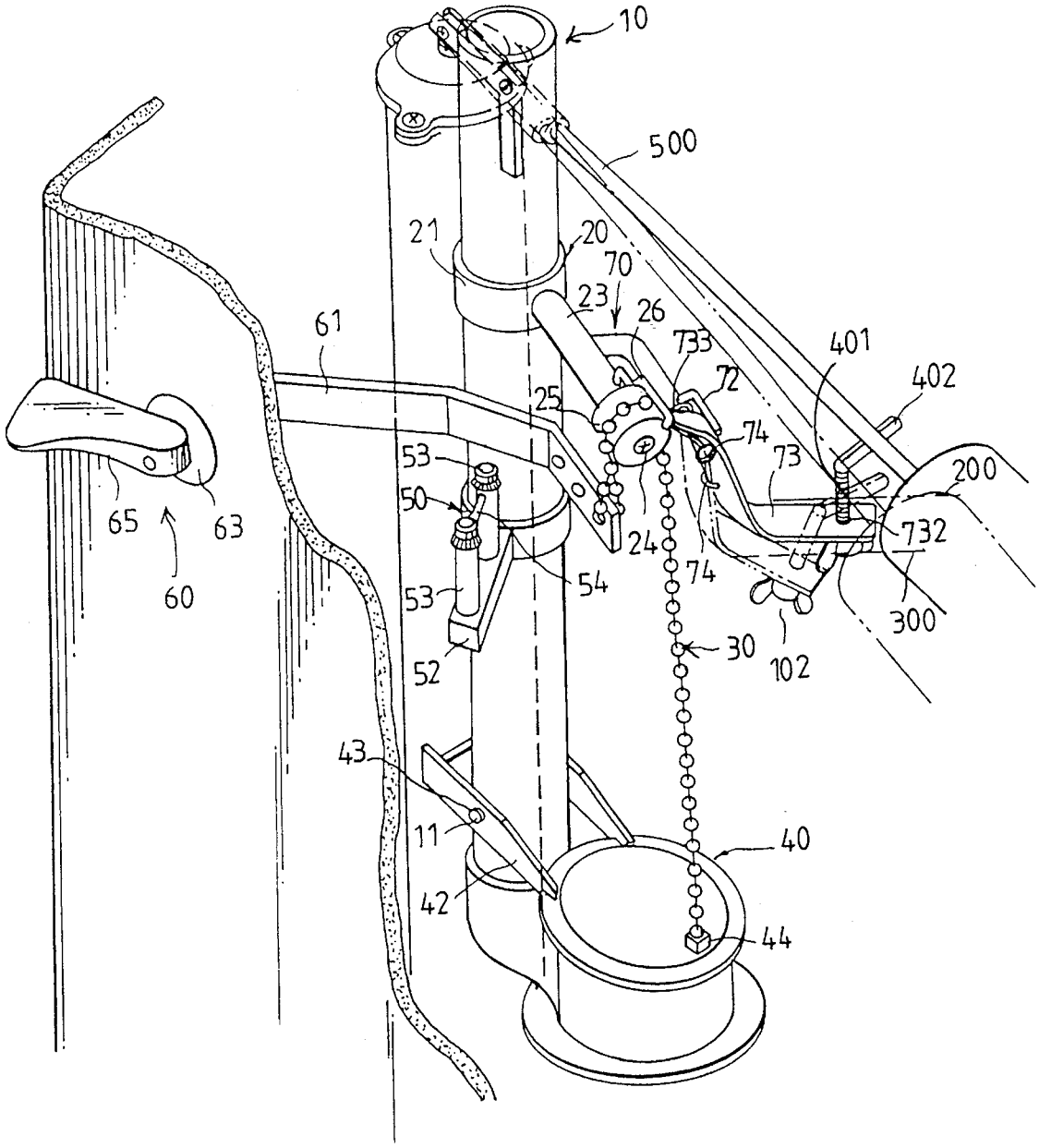
FIG. 8 is a perspective view to show the actuator arm being operated to release a small amount of the flush water according to the alterative embodiment of the present invention.

Referring to FIGS. 3, 4 and 5, the check point 733 of the lever 73 is stopped in the gap 31 of the chain 30 when the water is at highest lever 200 (as shown in FIG. 8). When the chain 30 and the outlet valve 40 move slightly upward to a selective span, the check point 733 still stops in the gap 32 of the chain 30 instantaneously before the water level inside the tank begins to drop downward (as shown in FIG. 4) which checks the chain 30 from downward movement. When the water level begins to drop beneath the level 300, the float ball 100 drops which actuates the lever 73 rotating clockwise upon the threaded end 711 of the suspender 71 so as to gradually withdraw from the gap 32 and set the chain free to move downward. The outlet valve 40 drops down to close the valve seat under the water pressure (as shown in FIG. 5). Because the connection of the float ball 100 with the lever 73 is adjustable, the selective span is also variable. For example, the threaded rod 101 of the float ball 100 can be vertically displaced in the circular hole 732 of the lever 731 to define a minimum amount of flush water for the selective span or to concur with the different water level in the water tank. If the float ball 10 is upside down on the lever 73, it will provide maximum amount of flush water for the selective span (as shown in FIG. 2). The provision of the check member 70 to the original device described in the aforementioned patent has the advantages that the user needs not to press the strip handle 65 continuously and the discharge amount of the flush water for the selective span becomes adjustable.

Figure 7:
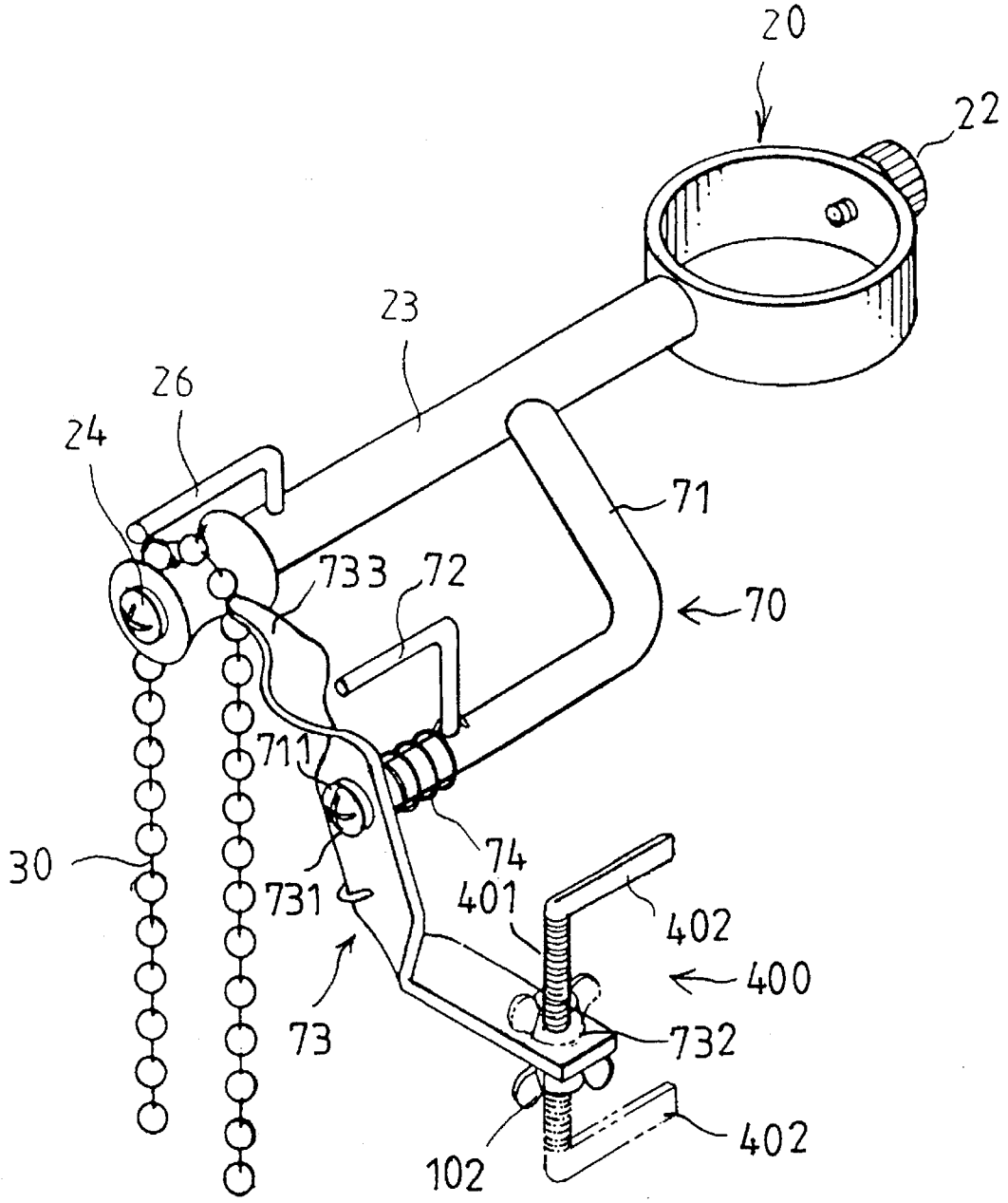
FIG. 7 is a perspective view to show an alterative embodiment according to the present invention.

Referring to FIGS. 7 and 8 of the drawings, an alterative embodiment of the check member 70 of the present invention has been provided in which a roughly L-shape rod means 400 is utilized instead of the float ball 100. A cantilever spring 74 of predetermined elasticity biased in the proximity of the free end of the L-shape suspender 71 has one arm anchoring to the inward periphery of the catch pin 72 and the other arm anchoring to the under side of the lever 73 so as to provide sufficiently resilient elasticity to urge the check point 733 normally positioned into a gap of the lift chain. The L-shape rod means 400 has a threaded vertical portion 401 secured into the screw hole 732 of the lever 73 and affixed by means of the wing nut 102 with the transverse portion 402 underneath the float arm 500 of the flush tank in a predetermined space. When the lift chain 30 together with the outlet valve 40 are slightly lifted during a selective span, as the check point 733 shifts to another gap of the chain 30, the chain 30 will be held instantaneously before the water level begins to drop (as shown in FIGS. 4 and 5). Then the transverse portion 402 of the L-shape rod means 400 will be pressed by the float arm 500 moving downward to actuate the lever 73 rotating clockwise on the free end of the suspender 71 so that the check point 733 is gradually withdrawn from the gap of the lift chain 30 when the water runs to a low level 300 and sets the lift chain 30 free to move downward. The outlet valve 40 drops down to close the valve seat and the L-shape rod means returns to normal position as soon as the water in the tank is replenished to maximum level again. The L-shape rod means 400 can be vertically displaced also, or upside down as shown in FIG. 7, to facilitate a variation of discharge amount of flush water for the selective span.

Figure 6:
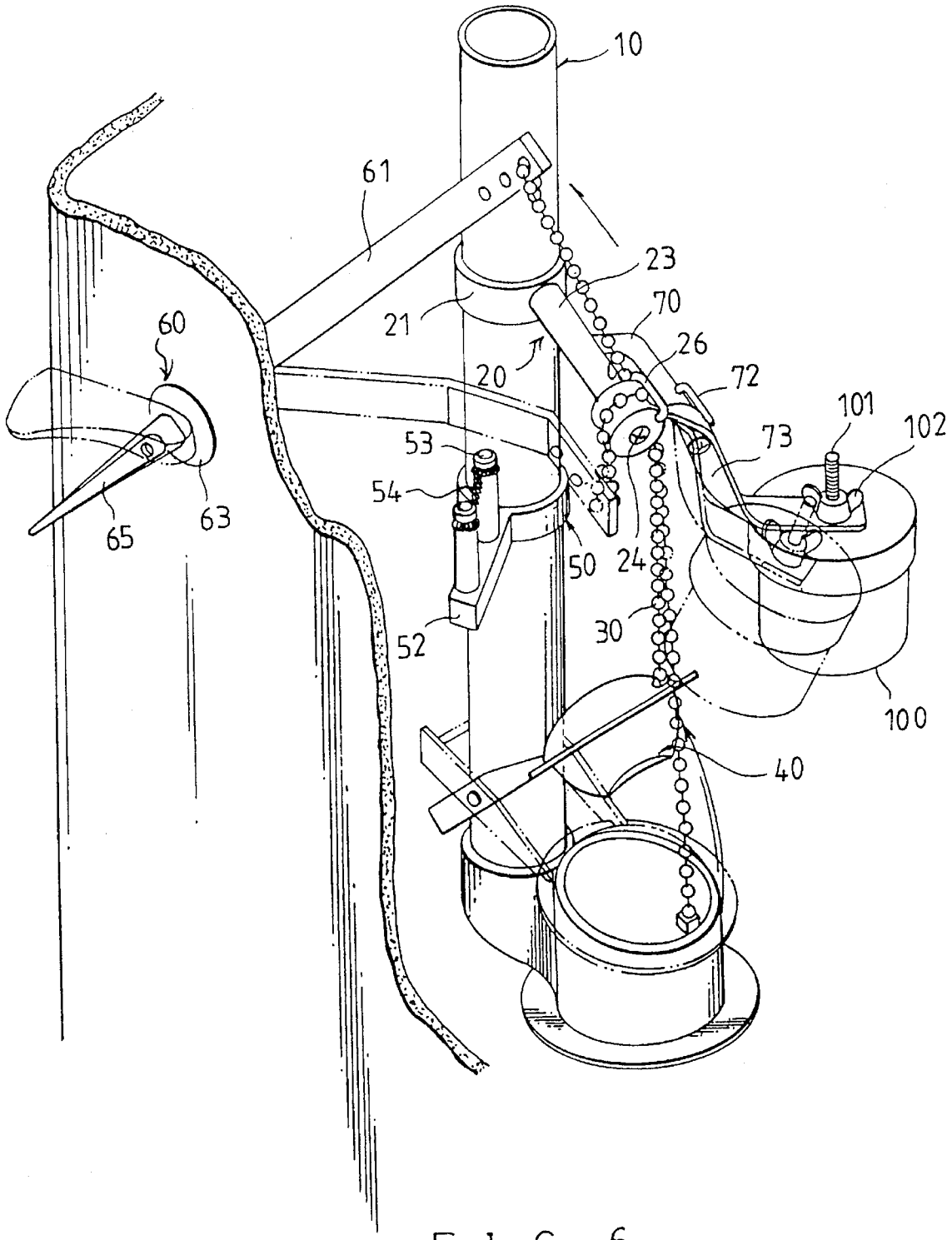
FIG. 6 is a perspective view of FIG. 1 to show an outlet valve being fully operated upon the valve seat according to FIG. 5.

Referring to FIGS. 5 and 6, the retricting member 50 of this invention is vertically displaceable along the overflow tube 10 to decide a preferred normal discharge amount of the flush water. When the user presses the strip handle 65 counterclockwise as the lift wire 30 is tight to an appropriate tension (as shown in FIG. 6), the actuator arm turns upward to a maximum extent so as to lift the outlet valve 40 fully open allowing to discharge a largest amount of flush water into a toilet pan while the check member 70 on the support non functional. Because the outlet valve 40 fills with air, it tends to float and allows a continuous discharging of the flush water at a certain level. But when the water level in the tank runs low, the tank ball drops down its own weight and thus closes the valve seat to replenish the tank again.

When the user presses the strip handle 65 clockwise, the lever means turns downward to a selective span and stops against the recoil spring 54 of the restricting member 50. So that the outlet valve 40 is pulled to lift up in a limited extent and held by the check member 70 instantaneously therefore allowing a smaller amount of flush water to be discharged therefrom. The discharge time is controlled by adjusting the cheek member 70 as recited above until the sufficient flush activity is accomplished. Then the outlet valve 40 is automatically dropped down and closes the valve seat for replenishing the water in the tank.

However, the recoil spring 54 disposed between the vertical rods 53 of the restricting member 50 provides a certain elasticity to the actuator arm 61. When the arm enters the gap between the two vertical rods 53, it will not touch directly to the surfaces thereof in order to protect those surfaces from damage or to prevent the actuator arm 61 from being trapped therein. Furthermore, the recoil spring 54 provides adequate resilient force to the actuator arm 61 when it turns back to a normal position.

Figure 11:
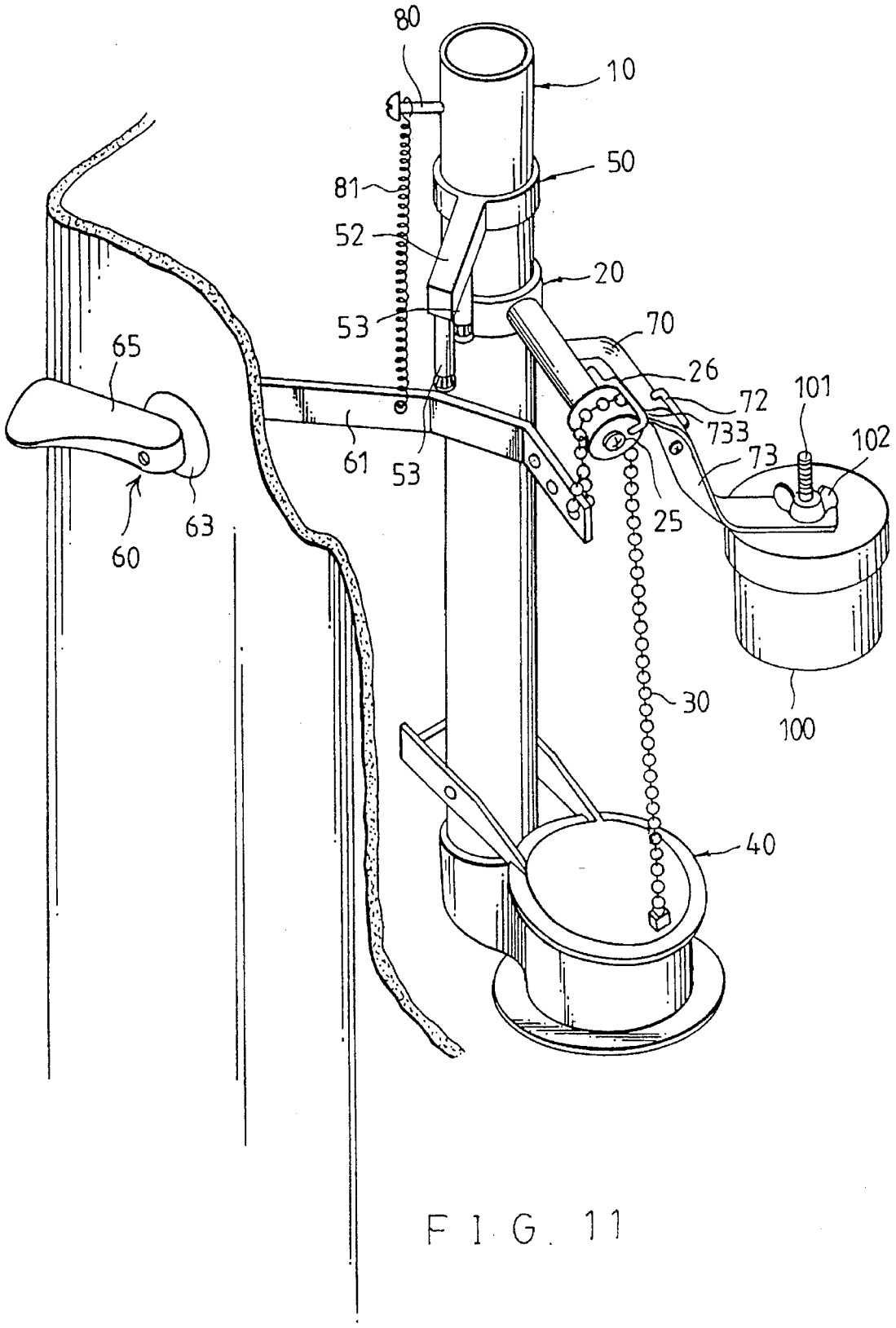
FIG. 11 is a perspective view to show an invertable displacement of the retricting member of the present invention.

With reference to FIG. 11 of the drawings, which shows an alterative mode of the present invention, the restricting member 50 is turned upside down and affixed to a position on the overflow tube above the support arm 20. A tension spring 81 is added to provide adequate tension to force the lever bar 61 back to normal position. The spring 81 suspends on one end from a screw 80 on a upper periphery of the overflow tube 10 and the other end from the medial portion of the actuator arm 61.

When a user presses the strip handle 65 clockwise, the actuator arm 61 turns downward to a maximum extent so as to affect the outlet valve 40 to be fully opened allowing a largest discharge amount of the flush water. When the outlet valve tends to drop down, the actuator arm 61 is promptly resiled back to its normal position under a resilient force of the tension spring 81. When a user presses the strip handle 65 counterclockwise the actuator arm 61 turns upward and is restricted by the restricting member 50 to limit the outlet valve 40 opening which is held by the check member 70 instantaneously for allowing a small amount of the flush water to be discharged.

Referring again to FIG. 10, the sectional view shows that the flaps 641 of the detent 64 inside the semi-circular groove 631 form a pair of angles θ in between the end walls of the groove 631 such that when the protrudent stopper 651 reaches the end of the groove 631, it will be stopped against and recoiled from the flap 641 for readily setting back to a normal position.

Note that the specification relating to the above embodiment should be construed as to be exemplary rather than as to limitative of the present invention, with many variations and modifications being readily attainable by a person of average skill in the art without departing from the spirit or scope thereof as defined by the appended claims and their legal equivalents.

I claim:

1. A flush device for a toilet, comprising a support element, a restricting member and an outlet valve adapted to be attached in series to an overflow tube of a flush tank, and an actuating assembly connected to said outlet valve via said support element by a flexible connector;

said support element comprising a laterally extending body having one end adapted to be connected to the overflow tube a pulley and a catch member attached to the other end, and a check member connected to a periphery of said extending body;

said check member comprising an L-shape suspender having a free end, a catch pin at an upper periphery in the proximity of said free end, a lever having a roughly Z-shape flat body pivotally connected at a medial bore to said free end of said suspender, said lever having a check point at one end and an aperture at the other end thereof, and a float ball having a rod adjustably secured to said aperture of said lever;

said restricting member comprising an elongate laterally extending body having a retaining ring connected to one end for attachment to the overflow tube, a pair of rods spacedly projecting upwardly from an upper surface of said elongate body, and a spring connected between said rods;

said outlet valve comprising a body having a hollow interior, a flange formed on upper portion thereof, a clevis attached at one end to said valve body with another end of said clevis adapted to be pivotally attached to said overflow tube, and means for connection to said flexible connector;

said actuating assembly comprising an actuator arm and handle adapted to be pivotally fastened to said flush tank, said flexible connector having one end attached to said actuator arm and another end attached to said connection means with said connector passing over said pulley between said pulley and catch member;

whereby actuation of said handle in one direction will open said outlet valve for a full flush and actuation of said handle in an opposite direction will cause said actuator arm to engage said spring means for opening said outlet valve for a partial flush.

2. A flush device according to claim 1, further has a jack means for engaging with said actuator arm and said handle, said jack means having a semi-circular groove and notch member on a front side receiving a detent and a protruding member therein.

3. A flush device according to claim 2, said detent having a flap at opposing ends abutting end walls of said semi-circular groove.

4. A flush device according to claim 1, wherein said restricting member is positionally displaceable and invertible on the outer periphery of said overflow tube.

5. A flush device according to claim 1, further including a spring member for suspending said actuator arm from said overflow tube.

6. A flush device according to claim 1, wherein said float ball can be invertibly secured to said lever of said check member.

7. A flush device for a toilet, comprising a support element, a restricting member and an outlet valve adapted to be attached in series to an overflow tube of a flush tank, and an actuating assembly connected to said outlet valve via said support element by a flexible connector;

said support element comprising a laterally extending body having one end adapted to be connected to the overflow tube, ring, a pulley and a catch member attached to the other end, and a check member connected to a periphery of said extending body;

said check member comprising an L-shape suspender having free end, a catch pin at an upper periphery in the proximity of said free end, a lever having a roughly Z-shape flat body pivotally connected at a medial bore to said free end of said suspender, said lever having a check point at one end and an aperture at the other end thereof, a cantilever spring connected between said free end and said catch pin and having one arm anchoring to said catch pin and the other arm anchoring to said lever, and a roughly L-shape rod having a threaded vertical portion adjustably connected to said aperture of said lever means and a transverse portion adapted to be positioned beneath a float arm of said flush tank;

said restricting member comprising an elongate laterally extending body having a retaining ring connected to one end for attachment to the overflow tube, a pair of rods spacedly projecting upwardly from an upper surface of said elongate body, and a spring connected between said rods;

said outlet valve comprising a body having a hollow interior, a flange formed on upper portion thereof, a clevis attached at one end to said valve body with another end of said clevis adapted to be pivotally attached to said overflow tube, and means for connection to said flexible connector said actuating assembly comprising an actuator arm and handle adapted to be pivotally fastened to said flush tank, said fleible connector having one end attached to said actuator arm and another end attached to said connection means with said connector passing over said pulley between said pulley and catch member;

whereby actuation of said handle in one direction will open said outlet valve for a full flush and actuation of said handle in an opposite direction will cause said actuator arm to engage said spring for opening said outlet valve for a partial flush.

8. A flush device according to claim 7, further has a jack means for engaging with said actuator arm and said handle, said jack means having a semi-circular groove and notch member on a front side receiving a detent and a protruding member therein.

9. A flush device according to claim 8, said detent having a flap at opposing ends abutting end the walls of said semi-circular groove.

10. A flush device according to claim 7, wherein said restricting member is positionally displaceable and invertible on the outer periphery of said overflow tube.

11. A flush device according to claim 7, further including a spring member for suspending said actuator arm from said overflow tube.

12. A flush device according to claim 7, wherein said L-shape rod can be invertibly connected to said lever of said check member.

* * * * *